US009714493B1

(12) United States Patent
Dyke et al.

(10) Patent No.: US 9,714,493 B1
(45) Date of Patent: Jul. 25, 2017

(54) APPARATUS FOR ABSORBING ENERGY WHEN IMPACTED BY A VEHICLE

(71) Applicant: LINDSAY TRANSPORTATION SOLUTIONS, INC., Omaha, NE (US)

(72) Inventors: Gerrit Andrew Dyke, Stockton, CA (US); Joseph Martin Sicat, Pleasanton, CA (US)

(73) Assignee: Lindsay Transportation Solutions, Inc., Omaha, NE (US)

( * ) Notice: Subject to any disclaimer, the term of this patent is extended or adjusted under 35 U.S.C. 154(b) by 0 days.

(21) Appl. No.: 15/099,952

(22) Filed: Apr. 15, 2016

(51) Int. Cl.

| | |
|---|---|
| ***E01F 15/00*** | (2006.01) |
| ***E01F 15/04*** | (2006.01) |
| ***E01F 15/02*** | (2006.01) |
| ***E01F 15/06*** | (2006.01) |

(52) U.S. Cl.
CPC ..... *E01F 15/0438* (2013.01); *E01F 15/025* (2013.01); *E01F 15/06* (2013.01)

(58) Field of Classification Search
CPC ..... E01F 15/02; E01F 15/025; E01F 15/04; E01F 15/143; E01F 15/146
See application file for complete search history.

(56) References Cited

U.S. PATENT DOCUMENTS

| | | | | |
|---|---|---|---|---|
| 4,928,928 | A | 5/1990 | Buth et al. | |
| 5,078,366 | A | 1/1992 | Sicking et al. | |
| 5,775,675 | A | 7/1998 | Sicking et al. | |
| 6,022,003 | A * | 2/2000 | Sicking | E01F 15/143 256/13.1 |
| 6,715,735 | B2 | 4/2004 | Bligh et al. | |
| 6,719,483 | B1 | 4/2004 | Welandsson | |
| 7,185,882 | B2 | 3/2007 | Buth et al. | |
| 7,694,941 | B2 | 4/2010 | Abu-Odeh et al. | |
| 8,517,349 | B1 | 8/2013 | Ross et al. | |
| 8,905,382 | B2 | 12/2014 | Smith et al. | |
| 9,145,943 | B2 * | 9/2015 | Sicking | F16F 7/125 |
| 2014/0231735 | A1 * | 8/2014 | Harman | E01F 15/04 256/13.1 |

* cited by examiner

*Primary Examiner* — Jonathan Masinick
(74) *Attorney, Agent, or Firm* — Thomas R. Lampe

(57) ABSTRACT

Apparatus for absorbing energy when impacted by a vehicle includes guardrail forming structure for folding a guardrail including a pipe through which the guardrail passes and an elongated ramp-like guardrail engagement member in the pipe which cooperates with the pipe to apply compressive forces to the guardrail and fold the guardrail.

11 Claims, 3 Drawing Sheets

APPARATUS FOR ABSORBING ENERGY WHEN IMPACTED BY A VEHICLE

TECHNICAL FIELD

This invention relates to apparatus positioned at a guardrail lead end for absorbing energy resulting from vehicle impact lead end.

BACKGROUND OF THE INVENTION

It is well known to provide vehicle impact energy absorbing systems, often called "crash cushions" or "crash attenuators", adjacent to roadways as well as at other locations.

It is known generally to incorporate attenuators in operative association with end terminals for guardrails wherein a flattening or reshaping structure is employed at a guardrail lead end, which upon vehicle impact is movable along the guardrail to flatten or reshape the guardrail to absorb crash energy and decelerate the vehicle. The following patent documents are believed to be representative of the current state of the art in this field: U.S. Pat. No. 4,928,928, issued May 29, 1990, U.S. Pat. No. 5,078,366, issued Jan. 7, 1992, U.S. Pat. No. 8,905,382, issued Dec. 9, 2014, U.S. Pat. No. 6,719,483, issued Apr. 13, 2004, U.S. Pat. No. 5,775,675, issued Jul. 7, 1998, U.S. Pat. No. 7,185,882, issued Mar. 6, 2007, U.S. Pat. No. 8,517,349, issued Aug. 27, 2013, U.S. Pat. No. 6,715,735, issued Apr. 6, 2004 and U.S. Pat. No. 7,694,941, issued Apr. 13, 2010.

DISCLOSURE OF INVENTION

The present invention relates to apparatus positioned at a guardrail lead end for absorbing energy resulting from vehicle impact. The apparatus includes an impact terminal and support structure supporting the impact terminal at a location spaced from the guardrail lead end, the support structure extending from the impact terminal toward the guardrail lead end.

The apparatus additionally includes a forming structure supported by the support structure. The forming structure defines an interior, a guardrail receiving opening communicating with the interior receiving the guardrail lead end and a guardrail discharge opening communicating with the interior.

The support structure and the forming structure are operable upon vehicle impact on the impact terminal to move along the guardrail and cause the guardrail to pass through the forming structure and a portion of the guardrail to exit the guardrail discharge opening.

The forming structure includes a pipe having an inner pipe wall defining the interior, the pipe configuration changing between the guardrail receiving opening and the guardrail discharge opening. The guardrail is in engagement with the inner pipe wall and compressive forces are applied to the guardrail by the pipe during passage of the guardrail through the forming structure to cause folding of the guardrail.

The forming structure additionally comprises an elongated guardrail engagement member within the pipe and extending at least partially along the length thereof for engaging a side of the guardrail to apply additional compressive forces to the guardrail to cause folding of the guardrail.

Other features, advantages and objects of the present invention will become apparent with reference to the following description and accompanying drawings.

BEST MODE FOR CARRYING OUT THE INVENTION

Figures 1, 2:
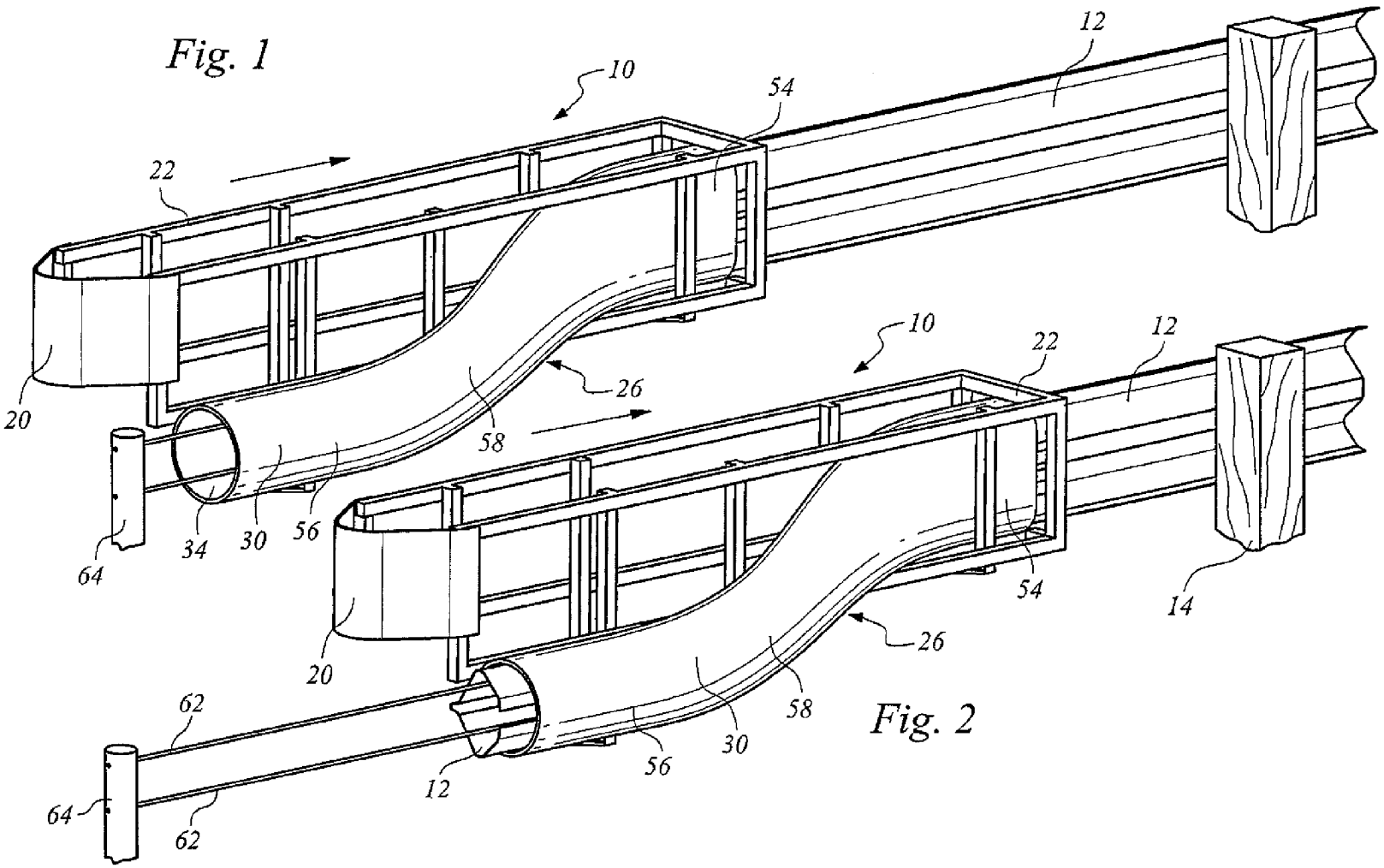
FIG. 1 is a perspective view of apparatus constructed in accordance with the teachings of the present invention located at the lead end of a guardrail and prior to vehicle impact on the impact terminal of the apparatus which would move the apparatus in the direction of the arrow.
FIG. 2 shows the position of the apparatus relative to the guardrail after vehicle impact has moved the apparatus relative to the guardrail.
Figure 3:
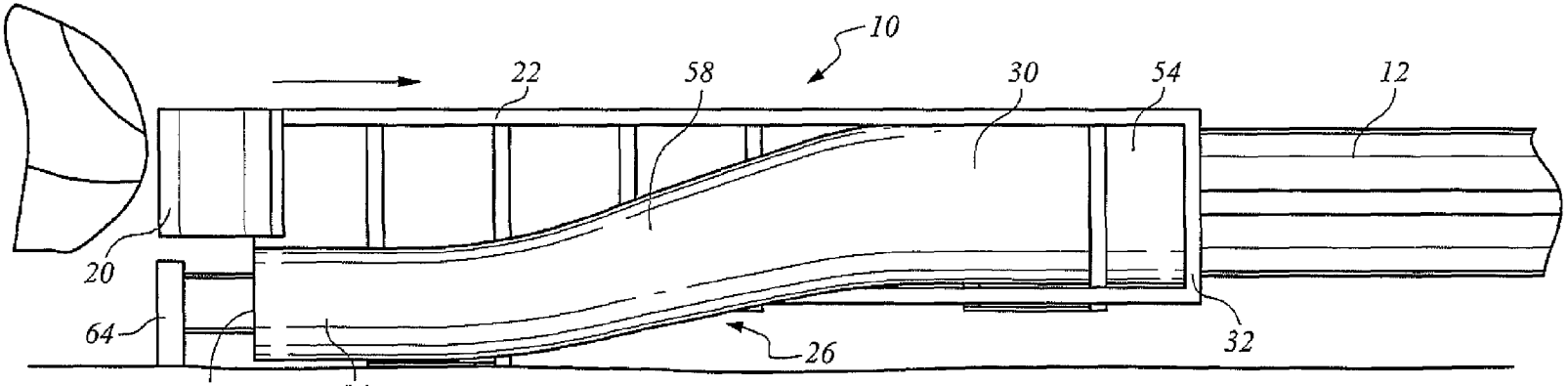
FIG. 3 is a side elevation view showing the apparatus in the condition illustrated in FIG. 1 being approached by a vehicle which would initiate movement of the apparatus relative to the guardrail in the direction of the arrow.

Referring now to the drawings, apparatus constructed in accordance with the teachings of the present invention is designated by reference numeral 10. Apparatus 10 is positioned at the lead end of a guardrail 12 supported by posts, one of which appears in FIGS. 1 and 2 and is designated by reference number 14.

Apparatus 10 includes an impact terminal 20 which is supported by a support structure in the form of a framework 22 positioned on the ground. Framework 22 supports the impact terminal at a location spaced from the guardrail lead end, the framework extending from the impact terminal toward the guardrail lead end.

A forming structure 26 supported is supported by the framework. The forming structure 26 includes a pipe 30. Pipe 30 defines an interior, a guardrail receiving opening 32 communicating with the interior and which receives the guardrail lead end, and a guardrail discharge opening 34 also communicating with the interior.

The guardrail receiving opening 32 is oblong and the guardrail discharge opening 34 is circular.

The pipe 30 has an inner pipe wall 36 which defines the interior. The pipe configuration changes between the guardrail receiving opening and the guardrail discharge opening.

Figure 5:
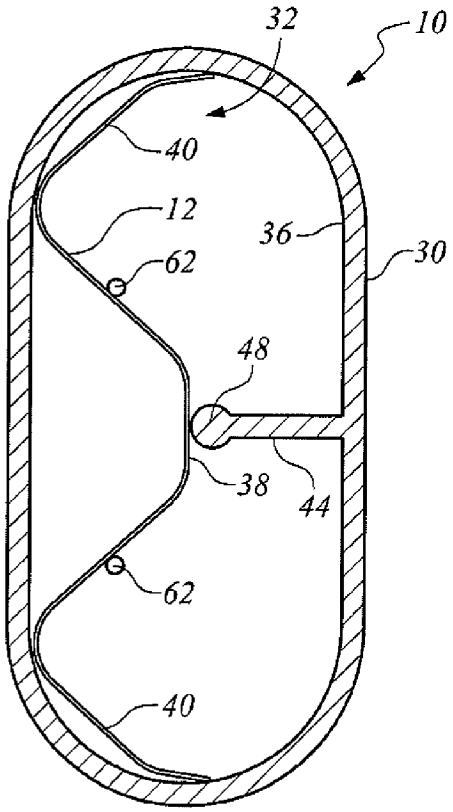

As may be seen with reference to FIG. 5, the guardrail 12 is in engagement with the inner pipe wall immediately adjacent to the guardrail receiving opening.

The illustrated guardrail is of conventional W-shaped construction having an elongated central portion 38 midway between upper and lower edge portions 40 of the guardrail. In FIG. 5 these edge portions engage upper and lower segments of the oval-shaped pipe portion defining the oval-shaped guardrail receiving opening 32.

The forming structure 26 also includes an elongated guardrail engagement member 44 (see FIGS. 5 and 6) within the pipe 30 and extending partially along the length of the pipe. The elongated guardrail engagement member engages a side of the guardrail and is cooperable with the pipe inner wall to apply compressive forces to the guardrail to fold the guardrail when vehicle impact forces the framework and forming structure to move along the guardrail. The elongated guardrail engagement member is affixed to the inner pipe wall and projects inwardly within the interior of the pipe to engage the side of the guardrail between spaced locations of contact between the inner pipe wall and the guardrail. More particularly, the elongated guardrail engagement member engages the guardrail substantially intermediate locations of contact between the inner pipe wall and the guardrail during passage of the guardrail through the pipe.

Figure 7:
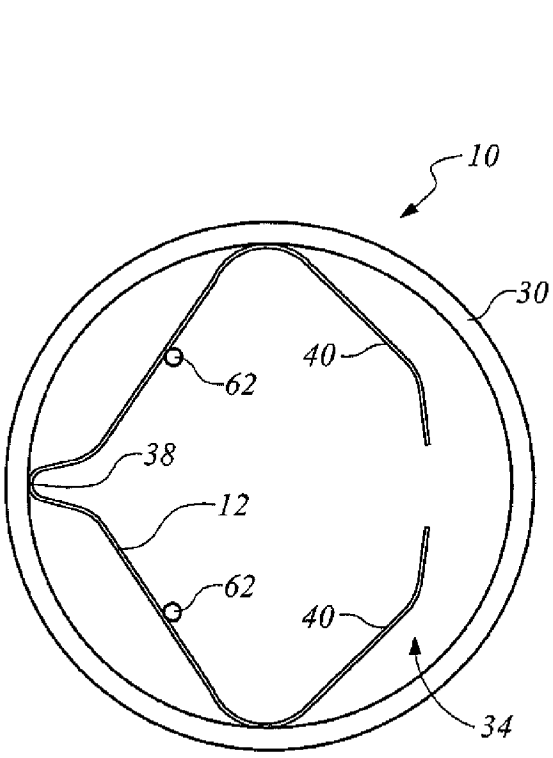
FIGS. 5-7 are greatly enlarged cross-sectional views taken along the lines 5-5, 6-6 and 7-7 of FIG. 4.
Figure 6:
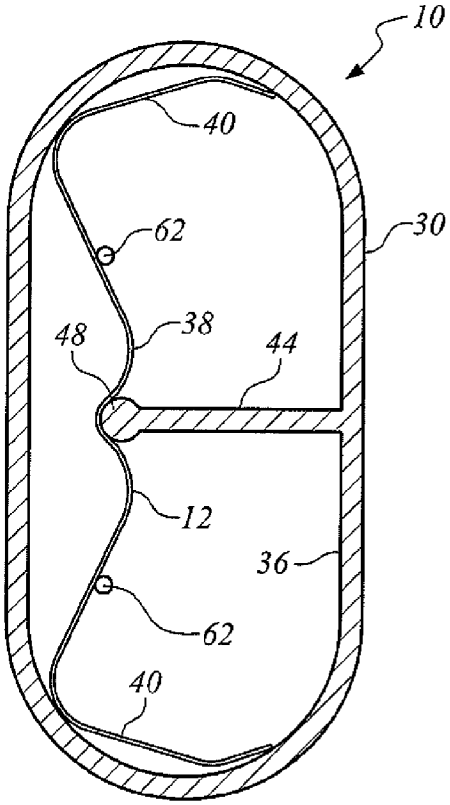

The elongated guardrail engagement member 44 is generally wedge shaped and has a guardrail contact surface 48 progressively extending a greater distance into the pipe interior in the direction of the guardrail discharge opening. During relative movement between the apparatus and the guardrail the elongated central protrusion 38 of the guardrail is engaged and deformed by the elongated guardrail engagement member. FIGS. 6 and 7 show, respectively, a partial bending and deformation of the projection and final deformation condition wherein the projection is reversed to create a bend for the folded guardrail. In the arrangement illustrated, the guardrail contact surface 48 is rounded to create a curved bend. The guardrail is folded along a bend extending along the longitudinal axis of the guardrail and located intermediate the upper and lower edges of the guardrail.

Pipe 30 includes a first pipe portion 54 forming the guardrail receiving opening and a second pipe portion 56 defining the guardrail discharge opening. The first pipe portion is elevated relative to the second pipe portion.

The pipe includes a third pipe portion 58 between and attached to the first pipe portion and the second pipe portion, the third pipe portion being inclined downwardly in the direction of the second pipe portion. The third pipe portion 58 also projects laterally outwardly so that the axis of second pipe portion 56 adjacent to the guardrail discharge opening is offset from the axis of the guardrail. The pipe is curved at the intersections of the third pipe portion with the first pipe portion and with the second pipe portion to promote smooth passage of the pipe along the guardrail upon vehicle impact.

Figure 4:
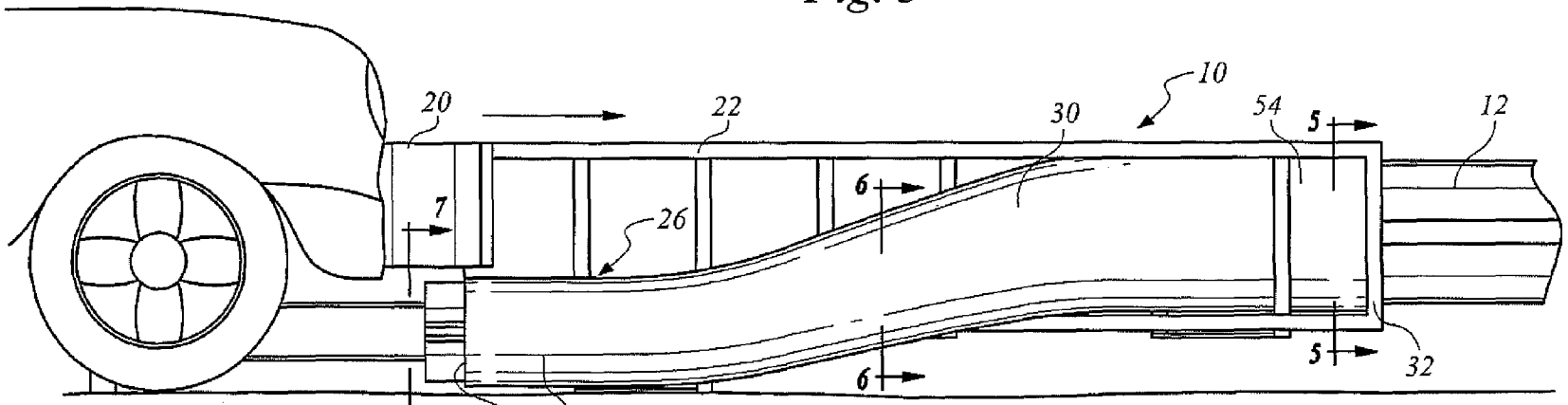
FIG. 4 is a view similar to FIG. 3, but illustrating the apparatus in the condition shown in FIG. 2 wherein it has moved to the right along the guardrail by the vehicle.

FIGS. 2 and 4 show the lead end segment of the folded over pipe exiting the guardrail discharge opening 34. In the arrangement illustrated, two cables 62 attached to a cable securement structure in the form of a anchor post 64 extend to and along the guardrail through the pipe, being positioned within the interior of the folded guardrail exiting from the guardrail discharge opening to guide positioning of the folded guardrail after exit.

The invention claimed is:

1. Apparatus positioned at a guardrail lead end for absorbing energy resulting from vehicle impact, said guardrail having an upper edge portion, a lower edge portion, and a guardrail wall having opposed first and second wall sides between said upper and lower edge portions, said apparatus comprising:

an impact terminal;

a support structure supporting said impact terminal at a location spaced from the guardrail lead end, said support structure extending from said impact terminal toward said guardrail lead end;

a forming structure supported by said support structure, said forming structure defining an interior, a guardrail receiving opening communicating with said interior receiving the guardrail lead end, and a guardrail discharge opening communicating with said interior, said support structure and said forming structure operable upon vehicle impact on said impact terminal to move along said guardrail and cause said guardrail to pass through said forming structure and a portion of said guardrail to exit said guardrail discharge opening, the forming structure including a pipe having an inner pipe wall defining said interior, said inner pipe wall changing configuration between said guardrail receiving opening and said guardrail discharge opening, said guardrail upper edge portion and lower edge portion in engagement with said inner pipe wall, and said pipe applying simultaneous variable compressive forces on said guardrail upper edge portion and said lower edge portion during passage of said guardrail through said forming structure to cause folding of said guardrail, and said forming structure additionally including an elongated guardrail engagement member within said pipe affixed to said inner pipe wall and projecting inwardly within said interior to engage the first wall side of said guardrail between spaced locations of engagement between said inner pipe wall and said guardrail upper edge portion and said lower edge portion and extending at least partially along the length of said pipe for engaging the first wall side of said guardrail to apply additional compressive forces to said guardrail between said upper and lower edge portions causing deformation of said guardrail and formation of an elongated protrusion in the guardrail wall extending outwardly from said second wall side of said guardrail between said upper and lower edge portions and causing folding of said guardrail at said protrusion.

2. The apparatus according to claim 1 wherein said guardrail receiving opening is oblong.

3. The apparatus according to claim 2 wherein said guardrail discharge opening is substantially circular.

4. The apparatus according to claim 1 wherein said elongated member engages said guardrail substantially intermediate the locations of contact between said inner pipe wall and said guardrail upper and lower edge portions.

5. The apparatus according to claim 1 wherein said elongated guardrail engagement member is generally wedge shaped and has a guardrail contact surface progressively extending a greater distance into said pipe interior in the direction of said guardrail discharge opening.

6. The apparatus according to claim 5 wherein said guardrail contact surface is rounded.

7. The apparatus according to claim 1 additionally comprising at least one cable extending from the guardrail through the pipe and positioned within the interior of the folded guardrail exiting from said guardrail discharge opening.

8. The apparatus according to claim 7 wherein said at least one cable is attached to a cable securement structure adjacent to said guardrail discharge opening.

9. The apparatus according to claim 1 wherein said support structure is a rigid framework secured to said forming structure.

10. The apparatus according to claim 9 wherein said framework is positioned on the ground and movable relative to the ground upon vehicle impact of a predetermined magnitude on said impact terminal.

11. The apparatus according to claim 1 wherein said guardrail is a W-shaped guardrail having an existing elongated central protrusion extending outwardly from said first wall side engaged and deformed by said elongated guardrail engagement member to project outwardly from said second wall side.

* * * * *